United States Patent [19]

Numata et al.

[11] 4,409,436

[45] Oct. 11, 1983

[54] STEREO PILOT SIGNAL ELIMINATING CIRCUIT FOR AM STEREOPHONIC RECEIVER

[75] Inventors: Tatsuo Numata; Akira Nishioka; Hitoshi Hirata, all of Tokyo, Japan

[73] Assignee: Pioneer Electronic Corporation, Tokyo, Japan

[21] Appl. No.: 274,562

[22] Filed: Jun. 17, 1981

[30] Foreign Application Priority Data

Jun. 19, 1980 [JP] Japan ..... 55-85914

[51] Int. Cl.[3] ..... H04H 5/00

[52] U.S. Cl. ..... 381/15; 381/28

[58] Field of Search ..... 179/1 GS, 1 GN, 1 GB

[56] References Cited

FOREIGN PATENT DOCUMENTS 55-109049 8/1980 Japan ..... 179/1 GS

*Primary Examiner*—R. J. Hickey

*Attorney, Agent, or Firm*—Sughrue, Mion, Zinn, Macpeak, and Seas

[57] ABSTRACT

An AM stereophonic receiver including a stereophonic pilot signal eliminating circuit which substantially completely eliminates a pilot signal in an input stage of a matrix detector. A received AM stereophonic signal, of the type in which the carrier signal is phase-modulated with a sub-signal and amplitude modulated by a main signal, is coupled to a main signal detector and a sub-signal detector. The output of the sub-signal detector is coupled through a band amplifier which produces as an output a signal corresponding to the pilot signal contained in the stereophonic signal. The outputs of the sub-signal detector and main signal detector are coupled to inputs of adder/subtractor circuit in a matrix detector while the output of the band amplifier is also coupled thereto in a phase so as to cancel the pilot signal contained in the output of the sub-signal detector.

6 Claims, 2 Drawing Figures

STEREO PILOT SIGNAL ELIMINATING CIRCUIT FOR AM STEREOPHONIC RECEIVER

BACKGROUND OF THE INVENTION

The invention relates to a stereo pilot signal eliminating circuit, and more particularly to a stereo pilot signal eliminating circuit for use in an AM stereophonic receiver.

In a known AM stereophonic system, transmission of AM stereophonic broadcasts is carried out by phase-modulating a carrier signal with a sub-signal which corresponds to the difference between the right and left channel signals after which the signal thus initially modulated is subjected to amplitude modulation with a main signal which is a sum signal of right and left channel signals. In this case, when the carrier wave is subjected to phase modulation, a low frequency (5 Hz or 25 Hz) stereo pilot signal, which is indicative of the presence of stereophonic signals, is superposed on the carrier signal together with the sub-signal.

In an AM stereophonic receiver adapted to receive such AM stereophonic broadcast signals, the main signal is detected by an envelope detector which extracts the variations in the amplitude component of the carrier signal. After removing the variations in the amplitude component of the carrier signal with a limiter, the sub-signal is detected by a sub-signal detector circuit. Then, both detected signals are multiplexed and the right and left channel signals are separately outputted.

In the above-described system, since the output of the detector circuit for the sub-signal contains the stereo pilot signal, the pilot signal is present in both of the right and left channel signal components when the detected outputs of the main signal and the sub-signal are multiplexed in a matrix circuit. This causes a deterioration of the output characteristics in the right and left channels. In order to solve this problem, a method has been employed in which a pilot signal eliminating filter is connected at the output of the matrix circuit. However, this method is disadvantageous in that the circuit arrangement is complicated and the response characteristics in the lower frequency ranges of the respective channel outputs are lowered.

Accordingly, an object of the present invention is to provide a pilot signal eliminating circuit for use in an AM stereophonic receiver in which the stereo pilot signal is cancelled by a simplified circuit arrangement and the frequency characteristics of the channel outputs are not substantially degraded.

SUMMARY OF THE INVENTION

Briefly, in the pilot signal eliminating circuit according to the invention, the pilot signal contained in the output of the sub-signal detector circuit is separated from the output thereof. The separated pilot signal is mixed with or added to the output of the sub-signal detector circuit with a phase opposite to the pilot signal component contained in the output of the sub-signal detector circuit. The mixing operation is carried out in the input stage of the matrix circuit for multiplexing the main and the sub-signal detected outputs.

More preferably, the circuit for separating and driving the stereo pilot signal is used commonly with a stereo pilot signal detector circuit for a stereo indicator.

DESCRIPTION OF THE PREFERRED EMBODIMENTS

Figure 1:
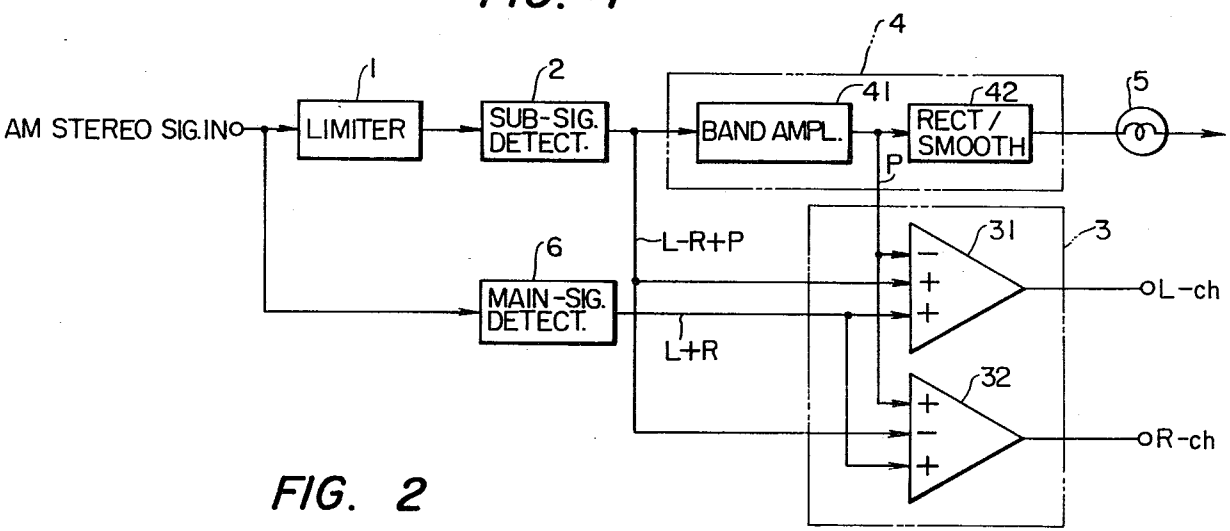
FIG. 1 is a block diagram showing a preferred embodiment of a pilot signal eliminating circuit of the invention.

A preferred embodiment of the invention will now be described with reference to FIG. 1 of the accompanying drawings. An IF (Intermediate Frequency) signal derived from a received AM stereophonic signal is applied to a limiter 1 where the amplitude variation component, i.e. the main signal (L+R), component is removed and then applied to a sub-signal detector circuit 2. The detected output of the sub-signal detector circuit 2 contains both the sub-signal (L−R) component and the stereo pilot signal (P) component. The output (L−R+P) of the sub-signal detector circuit 2 is applied to inputs of a matrix circuit 3.

A stereo pilot signal detector circuit 4 is provided which selectively separates the pilot signal (P) from the output of the sub-signal detector circuit 2. The stereo pilot signal detector circuit 4 includes a band amplifier 41 and a rectifier/smoothing circuit 42 with which the display of a stereo indicator 5 is controlled in response to the smoothed output. The pilot signal (P) separated by the band amplifier 41 is applied to another input of the matrix circuit 3.

The IF signal is further applied to a main signal detector circuit 6 where it is subjected to AM detection to provide the main signal (L+R) component. The main signal (L+R) component thus provided is also applied to the matrix circuit 3. The matrix circuit 3 includes adder/subtractor circuit 31 and 32. In the circuit 31, addition of the main and sub-signal detected output and subtraction of the pilot signal (P) from the added signal are performed. Accordingly, in the circuit 31 the operation of (L+R)+(L−R+P)−P is implemented to thereby provide the left channel (L) output. In the circuit 32, subtraction of the sub-signal detected output from the main signal detected output and addition of the pilot signal (P) are performed. Accordingly, in the circuit 32 the operation of (L+R)−(L−R+P)+P is implemented to thereby provide the right channel (R) output. In this manner, in the input stage of the matrix circuit, the stereo signal components contained in the sub-signal detector output and the output (P) of the detector circuit 4, which are opposite in phase to one another, are mixed so that the pilot signal is cancelled substantially perfectly.

Figure 2:
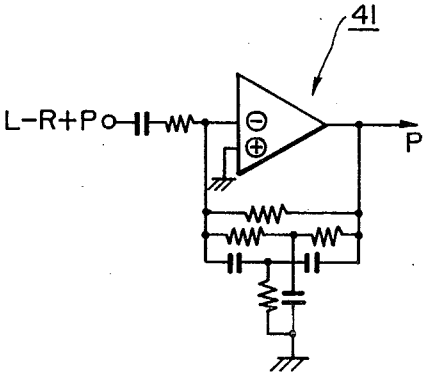
FIG. 2 is a circuit diagram showing a part of the circuit shown in FIG. 1.

FIG. 2 is a circuit diagram showing a specific example of the band amplifier 41 for the stereo pilot signal. This circuit is basically an active filter arrangement providing a predetermined bandpass frequency characteristic in a feedback circuit by the use of an operational amplifier. The band amplifier used with the invention is not limited to that shown in FIG. 2 but various modifications are possible insofar as the intended operation is performed.

As described above, according to the invention, the pilot signal is cancelled with an extremely simple circuit arrangement, the characteristics of the signal are not degraded due to the fact that no filters are necessary in the signal line, and the lower frequency range of the frequency response characteristics is improved. Furthermore, the overall circuit arrangement is enhanced with the use of the pilot signal detector circuit.

What is claimed is:

1. An AM stereophonic receiver circuit for an AM stereophonic signal in which a carrier signal is phase modulated by a sub-signal corresponding to a difference between right and left channel signals and amplitude modulated by a main signal corresponding to a sum of said right and left channel signals, comprising: means for receiving and producing an IF signal; a main signal detector having an input coupled to receive said IF signal; a sub-signal detector having an input coupled to receive said IF signal; first and second adder/subtractor circuits, an output of said sub-signal detector being coupled to an addition input of said first adder/subtractor circuit and to a subtraction input of said second adder/subtractor circuit, and an output of said main signal detector being coupled to addition inputs of both said first and second adder/subtractor circuit; and a stereo pilot signal detector circuit having an input coupled to said output of said sub-signal detector, said stereo pilot signal detector circuit producing an output signal corresponding to a pilot signal of a received stereophonic AM modulated signal, said output signal of said stereo pilot signal detector circuit being coupled to a subtraction input of said first adder/subtractor circuit and to an addition input of said second adder/subtractor circuit, a left channel output being produced at an output of said first adder/subtractor circuit and a right channel signal being produced at an output of said second adder/subtractor circuit.

2. The receiver of claim 1 wherein said stereo pilot signal detector circuit comprises a band amplifier.

3. The receiver of claim 2 further comprising a rectifier/smoothing circuit having an input coupled to receive said output signal of said stereo pilot signal detector circuit, an output of said rectifier/smoothing circuit being coupled to operate a stereo pilot lamp.

4. The receiver of claim 2 wherein said band amplifier comprises an active filter including an operational amplifier.

5. The receiver of claim 3 wherein said band amplifier comprises a first capacitor having a first terminal coupled to said output of said sub-signal detector; a first resistor having a first terminal coupled to a second terminal of said first capacitor; an operational amplifier having an inverting input coupled to a second terminal of said first resistor and a noninverting input terminal coupled to ground; a second resistor having a first terminal coupled to said inverting input of said operational amplifier and a second terminal coupled to an output of said operational amplifier; a third resistor having a first terminal coupled to said inverting input of said operational amplifier; a fourth resistor having a first terminal coupled to a second terminal of said third resistor and a second terminal coupled to said output of said operational amplifier; a second capacitor having a first terminal coupled to said inverting input of said operational amplifier; a third capacitor having a first terminal coupled to a second terminal of said second capacitor and a second terminal coupled to said output of said operational amplifier; a fifth resistor having a first terminal coupled to said second terminal of said second capacitor and a second terminal coupled to ground; and a fourth capacitor having a first terminal coupled to said second terminal of said third resistor and a second terminal coupled to ground.

6. The receiver of claim 1 further comprising a limiter circuit coupled to an input of said sub-signal detector wherein said IF signal is coupled through said limiter circuit to said input of said sub-signal detector.

* * * * *